US009545647B2

(12) United States Patent
Goegebeur et al.

(10) Patent No.: US 9,545,647 B2
(45) Date of Patent: Jan. 17, 2017

(54) MULTI-STEP PROCESS FOR FULLY COLOURED CONSTRUCTION ELEMENTS

(71) Applicants: Patrick Goegebeur, Zedelgem (BE); Bart Louwagie, Deinze (BE)

(72) Inventors: Patrick Goegebeur, Zedelgem (BE); Bart Louwagie, Deinze (BE)

(73) Assignee: Deceuninck NV, Hooglede-Gits (BE)

( * ) Notice: Subject to any disclaimer, the term of this patent is extended or adjusted under 35 U.S.C. 154(b) by 412 days.

(21) Appl. No.: 13/836,340

(22) Filed: Mar. 15, 2013

(65) Prior Publication Data

US 2013/0273329 A1 Oct. 17, 2013

(30) Foreign Application Priority Data

Mar. 19, 2012 (EP) ..... 12160232

(51) Int. Cl.

| | |
|---|---|
| ***B05D 1/00*** | (2006.01) |
| ***B05D 1/26*** | (2006.01) |
| ***B05D 7/02*** | (2006.01) |
| *B05D 3/04* | (2006.01) |

(52) U.S. Cl.

CPC . *B05D 1/00* (2013.01); *B05D 1/26* (2013.01); *B05D 7/02* (2013.01); *B05D 3/0493* (2013.01); *B05D 2401/00* (2013.01); *Y10T 428/24612* (2015.01); *Y10T 428/31855* (2015.04)

(58) Field of Classification Search

CPC ..... B05D 1/00; B05D 1/26; B05D 7/02; B05D 3/0493; B05D 2401/00; B05D 2201/02

USPC ... 427/294, 296, 412.1, 412.3, 412.4, 412.5; 52/94–96, 204.1, 204.5

See application file for complete search history.

(56) References Cited

U.S. PATENT DOCUMENTS

| | | | | |
|---|---|---|---|---|
| 3,915,117 | A * | 10/1975 | Schertler | C23C 14/566 118/719 |
| 4,333,417 | A * | 6/1982 | Camp | B05C 11/115 118/405 |
| 5,097,794 | A * | 3/1992 | Mahler | C23C 14/50 118/719 |
| 6,241,824 | B1 * | 6/2001 | Brauer | C23C 14/568 118/500 |
| 7,022,189 | B2 | 4/2006 | Delle Vedove et al. | |
| 7,235,282 | B2 * | 6/2007 | Tchapian | C08J 7/065 427/307 |
| 8,071,176 | B2 * | 12/2011 | Hanrahan | B05D 5/06 347/171 |
| 2007/0273989 | A1 * | 11/2007 | Hoffmann | C23C 14/0015 359/885 |

FOREIGN PATENT DOCUMENTS

EP 2 641 666 A2 * 9/2013

* cited by examiner

*Primary Examiner* — William Phillip Fletcher, III
(74) *Attorney, Agent, or Firm* — Levy & Grandinetti

(57) ABSTRACT

A multiple step coating process for coating a construction element having side portions, one of which is an unmasked transport side portion, and whereby at least three sides portions are coated, comprising:

(A) advancing the element past a vacuum coater first coating station on the unmasked transport side wherein a surface layer is applied onto one or more of the non transport side portions of the element; and (B) subsequently advancing said coated element into further vacuum coater coating stations wherein a surface layer to the unmasked transport side of (A) and/or one or more of the remaining sides of the element.

12 Claims, 4 Drawing Sheets

MULTI-STEP PROCESS FOR FULLY COLOURED CONSTRUCTION ELEMENTS

This Application claims priority to European Application Number EP2160232.0 filed on Mar. 19, 2012.

FIELD OF THE INVENTION

The present application relates to a process for providing coated construction elements, in particular for providing coated window profiles. The invention also relates to the construction elements, obtainable by said process.

The present application is particularly related to profile members used in the construction elements of windows, doors, gates or other constructional elements which are composed of a plurality of profile members, and more particular of profile members made of metal and/or wood and/or plastic. The plastic used can be either a thermosetting plastic or a thermoplastic. The profile members are preferably substantially made of PVC which can be low grade, high grade and recycled PVC.

BACKGROUND OF THE INVENTION

Although PVC construction elements such as profiles are the choice of many professional and consumers because of various reasons, many people still perceive PVC construction elements as having a "plastic" look.

On the one hand, the appearances of profiles have been addressed by coating construction elements such as profile members which can be provided with a coating e.g. by spray coating or by the application of a foil provided with a coating. Spray coating has the advantage that a relatively thick coating layer of e.g. a thermosetting resin can be applied such that this layer can comprise a polymeric powder to obtain the desired grained surface structure. However, a disadvantage of providing a coating by a spray coating method on a profile member is that those surfaces of the profile member which are not to be colored have to be masked first. Then those surfaces which are to be colored, are degreased to obtain good adhesion of the coating. Then the coating is applied by means of a spray unit in two or three successive layers, to the profile member, finally followed by for example air-drying of the coating or drying of the construction elements in a heated oven. Masking, to prevent overspray on profile surfaces, which are not intended to be painted, degreasing and spraying of the construction elements are carried out manually. The mask may be in the form of a fabric and/or film layer which is pressed and/or held against the surface of the profile on which no coating is desired. The mask may be in contact with the profile only during the vacuum coating or, in other embodiments of the invention, the mask is in contact with the profile through both the coating and curing steps and/or the mask is in contact with the profile during the entire time the profile is within any of the curing and/or coating device.

The drawback of this method is that it is very labor-intensive, time-consuming and creates high amounts of waste due to masking tape or other products used to cover non-painted surfaces. This method consequently results in low productivity and is very expensive. Owing to the wide variety of construction elements such as profile members and to their dimensions on the one hand, and to the difficulty of masking different parts of them on the other hand, automation of this method cannot be achieved in an efficient manner.

On the other hand, in coating applications requiring a high quality coating finish it is generally desirable to completely and evenly coat an object to be coated with a minimum expenditure of coating. This is desirable for several reasons. First, coatings for the above mentioned profile are often expensive. Therefore, reducing coating consumption offers the immediate benefit of reduced coating cost. Second, coating material which is not deposited upon the object to be coated can be lost to the environment and this loss generally is an environmentally undesirable form of waste. Therefore, reducing the quantity of coating lost to the environment in a coating process reduces the costs of disposing of the lost coating material and reduces emissions of coating solvents. Vacuum coating processes can be used, but such processes are limited to construction elements such as profiles having leading and trailing edges. Profiles have inside surfaces which form depressed or recessed areas of the profile between the front and rear edges of the profile. These recessed areas form leading and trailing edges which extend transverse to the direction of movement of the profile through the coating apparatus.

From the above, it is made clear that an object of the present invention is to provide a reduced "non plastic look" construction, in particular profiles such as window profiles, which do not have the drawbacks of conventional PVC construction elements and suffer from the drawbacks of the processing set out above.

The present invention is directed to solving this myriad of sometimes interrelated problems in a coating process which incorporates a number of features which, in combination, produces an extremely high quality coating and even an unexpected finish on difficult articles to be coated.

A further object of the present invention is to provide a new economically process which provides for a variety of aesthetic finishes, including a range of aesthetics and textured thereby resulting in said reduced plastic look finish.

In accordance with the present invention, it has now been found that the above-described specifications can be fulfilled by coated construction elements. The present invention provides for cost efficient and effective environment friendly process as well as desired specifications and properties of the products obtained thereof.

The object is achieved by method for providing a fully colored construction element such as a profile with a coating, the method comprising a multiple step coating process for coating a substrate construction element having side portions, whereby at least three sides portions are coated, characterized in that the process comprises the steps of A) advancing the element past a first coating station on its transport side for applying a surface layer onto one or more of the non transport side portions of the element and B) subsequently advancing said element into further coating stations for applying a surface layer to the transport side of A) or/and one or more of the remaining side portion of said element.

A second aspect of the present invention provides for a coated profile that matches standard todays coated PVC profiles in terms of finish, color fastness/long term weathering performance; gloss and long term gloss retention performance; impact performance and UV aged impact performance and surface hardness/scratch resistance;

Generally, it is known to spray paint or coat construction elements by an apparatus having a conveyor which moves parts to and through some form of spraying booth where one or more nozzles coat the construction elements with a coating composition. These apparatus or systems are limited by the amount of volatile organic compounds that the sprayed coatings emit, the amount of floor space required to cure the coatings and by limited transfer efficiency.

SUMMARY OF THE INVENTION

The present invention is directed to a multiple step coating process for coating a substrate construction element having side portions, whereby at least three sides portions are coated, characterized in that the process comprises the steps of A) advancing the element past a first coating station on its transport side for applying a surface layer onto one or more of the non transport side portions of the element and B) subsequently advancing said element into a further coating station for applying a surface layer to at least to the transport side of A) or/and one or more of the remaining side portion of said element.

DETAILED DESCRIPTION OF THE INVENTION

Process

A multiple step coating process for coating a substrate construction element (for example profile 1, 2, or 3 of FIGS. 1A, B, or C) having side portions, characterized in that the process comprises the steps of A) advancing the element past a first coating station on its transport side for applying a surface layer onto one or more of the non transport side portions of the element and B) subsequently advancing said element into further coating stations for applying a surface layer to the transport side of A) or/and one or more of the remaining side portion of said element.

According to a preferred embodiment of the present invention, the present invention is directed to a two step coating process whereby the construction element is a profile, said process comprising the steps of A) advancing the profile past a first coating station for applying a surface layer onto all non transport side portions of the profile and B) advancing said profile into a second coating station for applying a surface layer to the transport side portion of said profile.

The coating and curing may be carried out continuously in separate devices arranged in-line (FIG. 2A) or in the same device (FIG. 2B) having separate curing and coating chambers or portions. In one embodiment of the invention the curing is carried out in a curing tunnel. The construction element such as a profile may be carried through the coating and curing steps on a conveyor belt system, first traveling through a coating portion and subsequently traveling through a curing portion of one or more devices.

Figure 2A:
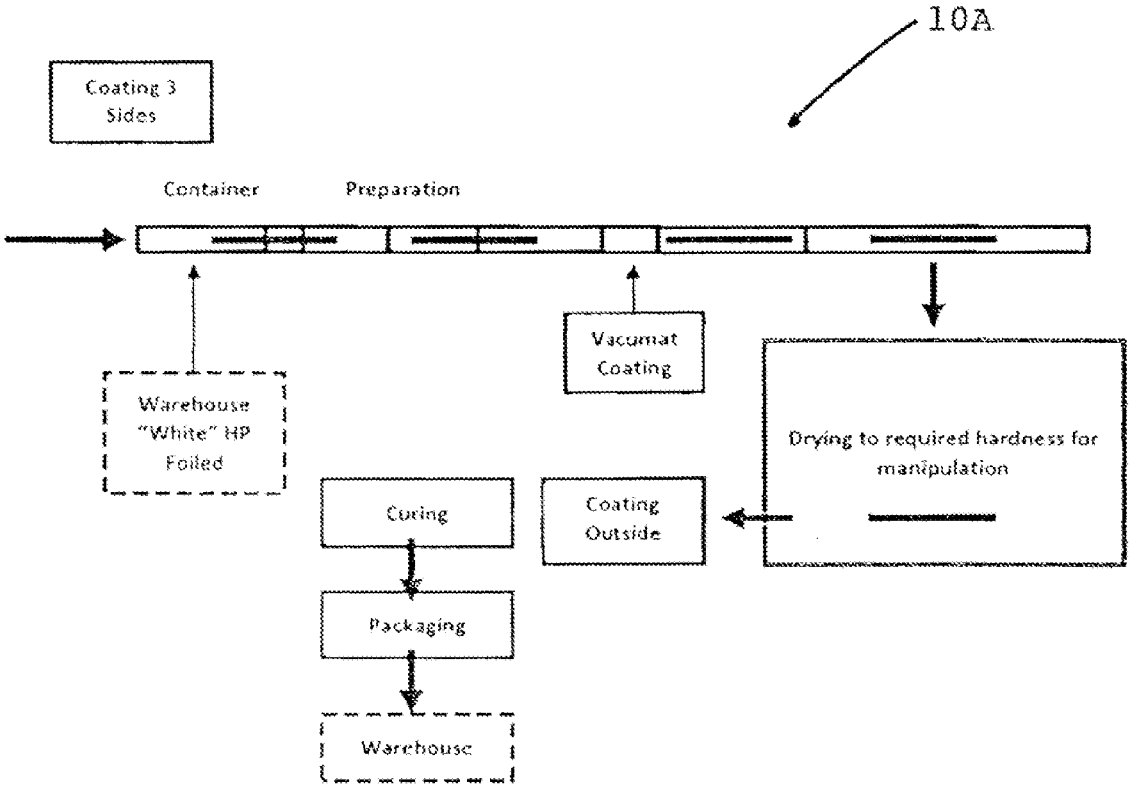
FIGS. 2A, B, and C is a schematic presentation of desirable embodiments of the process of the invention.
Figure 2B:
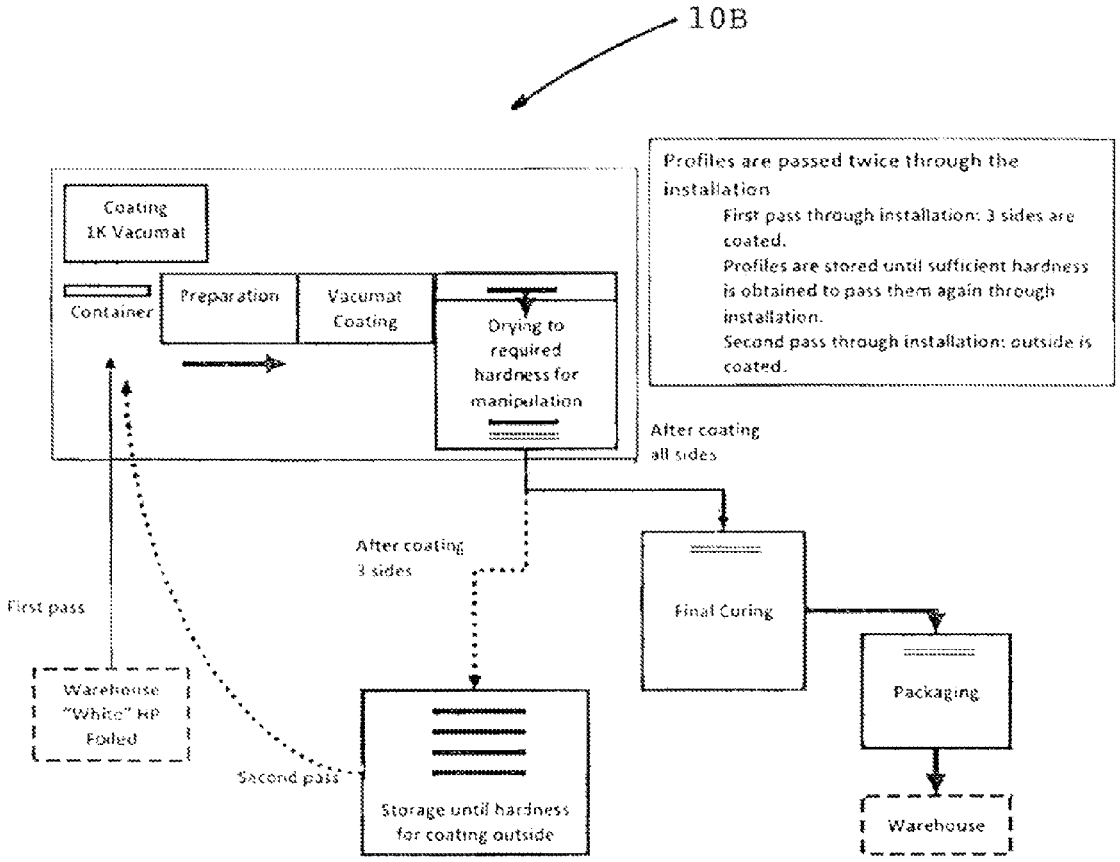

The profile may likewise be carried and/or guided through the process on rollers and/or conveyors. The profile is advanced e.g. pushed or pulled through both the coating and curing devices whereby the profile is in contact with any direct supporting means inside either the coating or curing device and/or chamber by its transport side of the profile. Separate mechanical supports may be located before and after the coating and curing devices. It may not be necessary for mechanical means to be in continuous contact with the entire length of the transport side of the profile. In some embodiments of the invention portions of the profile are free hanging, e.g., are unsupported between portions of the profile that are supported. Mechanical supports include devices such as rollers and conveyors such as conveyor belts or other conveyor systems. Desirable processes 10A, B, and C are illustrated in FIGS. 2A, B, and C.

Preferable coating devices are vacuum coaters. The vacuum coaters are described in U.S. Pat. Nos. 7,022,189 and 4,333,417 and are preferred devices for carrying out the coating of the process. Vacuum coating provides a means by which the profile is evenly exposed to a coating material such as a UV-curable ink, paint or other composition. Commercial vacuum coaters such as the MV15, MV30, VAC612, VAC100, and/or Vacumizer coaters available from DV Systems are examples of the vacuum coaters that may be used in the process of the invention.

A vacuum coater operates by exposing the surface of the construction element i.e. a profile to a stream of coating construction elements suspended in a stream of gas such as air. Vacuum coaters operate at pressures below ambient pressure. As a profile moves through a vacuum coater substantial amounts of air flow into the vacuum coater due to the pressure differential between the ambient atmosphere and the interior of the vacuum coater. The pressure inside the vacuum coater may range from 10 millibars to slightly less than ambient pressure (e.g., slightly less than about 1,000 millibars). The pressure inside the vacuum coater is preferably between 100 and 800 millibars, more preferably 150-650, 200-600, 250-550, 300-500, 350-400, and about 400 millibars. All subranges and values between the stated values are expressly included herein, e.g., those values between 100 and 150 millibar such as 105, 110, 115, 120, 125, 130, 135, 140 and 145 millibars are expressly included herein along with any range or subrange of any of the above stated and unstated values.

A coating material is simultaneously pumped into the vacuum coater chamber as the profile moves through the vacuum coater. The injection of coating material together with the flow of air or other gas into the vacuum coater due to the pressure differential existing between the interior of the vacuum coater and the ambient atmosphere causes the coating material to form a finely divided mist inside the vacuum coater. The flow of ambient atmosphere into the vacuum coater usually occurs at the edges of the opening of the vacuum coater that accommodates the entrance and exit of the substrate during coating. At relatively greater pressure differentials and higher gas flows a finer mist may be formed. A finer coating material mist includes coating material having a relatively smaller average particle diameter.

The vacuum coater includes an in-feed gate and an exit gate. Both the in-feed and exit gates may be cutouts that correspond to the cross sectional shape of the profile. The in-feed and exit gates are larger than the cross section of the profile to permit entry, exit and travel of the profile through the vacuum coater. Preferably the in-feed and exit gates are cutouts that stand off from the profile at a distance of from 0.1 mm to 10 mm, more preferably 0.2-9 mm, 0.3-8 mm, 0.4-7 mm, 0.5-6 mm, 0.6-5 mm, 0.7-4 mm, 0.8-4 mm, 0.9-3 mm, or 1-2 mm. In some embodiments of the invention the cut off has different stand off distances from the profile at different location along the profile cross-section. The vacuum coater may also be equipped with other cutouts that are useful for adjusting the pressure and/or gas flow inside the coater. For example, the vacuum coater may have one or more holes of any shape located at the exit end, in-feed end, top or bottom. By varying the size of the holes the gas flow characteristics through the vacuum coater may be changed.

The velocity of the air flow through the vacuum coater preferably from 1 fpm (feet per minute) to 1,000 fpm, preferably 10-900, 20-850, 303-800, 40-750, 50-700, 60-650, 70-600, 80-550, 90-500, 100-450, 150-400, 200-350, or 250-300 fpm. The volume of air flow through the vacuum coater is preferably from 100-5,000 m<3>/hr, preferably 150-4,500; 200-4,000; 250-3,500; 300-3,000; 350-2,500; 400-2,000; 450-1,500; 500-1,000; 550-950; 600-900; 650-850; 700-800 or about 750 m<3>/hr.

The pressure differential between ambient atmospheric pressure and the pressure inside the vacuum coater affects the coating process in several ways. By affecting the particle size of the coating material the pressure differential may be used as one means to optimize mist particle size to obtain improved coating on irregular surfaces. Second, at relatively greater pressure differentials the flow of ambient air into the vacuum coater and around the profile increases substantially. Increased airflow passing over the coated profile surface as it exists the vacuum coated chamber results in a flattening effect and forces excess coating material or overspray back into the vacuum coater chamber. High air velocity around the profile during exit from the vacuum coater likewise helps ensure the formation of an even coating on all surfaces of the profile.

Vacuum within the vacuum coater is typically provided by means of high power vacuum pumps. The vacuum pumps operate on a closed loop system to permit recycling of the coating material. Because transfer of the coating material mist onto the profile is not 100% efficient, substantial amounts of coating material may leave the vacuum coater chamber and enter a vacuum producing device used to generate a vacuum in the vacuum coater. Preferably the vacuum producing device includes a separator device which removes suspended coating material from the gas flow leaving the vacuum coater. The thus separated coating material is reclaimed and may be re-injected into the vacuum coater to reduce coating material consumption 1.5 and waste, In accordance with the present invention, during the coating step in the vacuum coater the profile is not to be covered or masked by tape such as in typical processes where contact needs to be avoided with the coating material.

In some embodiments of the invention the atmosphere entering the vacuum coater during the coating step is a gas of controlled composition. For example, instead of an inflow of ambient atmosphere a supply of an inert gas such as nitrogen may be flowed across the substrate surfaces as the substrate enters and exits the vacuum coater. In this embodiment of the invention there is lesser likelihood that the coating material reacts with any component of the inert gas. Further, by using an inert gas the humidity characteristics surrounding the profile during coating and curing can better be regulated.

After exiting the vacuum coater the coated substrate comprises a coating of curable coating material on those surfaces which were exposed during coating. The amount of coating material which is present on the exposed surfaces of the substrate may range from amounts of 5-1,000 g/m<2> based on the weight of the coating material and the area in m<2> of the coated surfaces of the substrate. Preferably the coating material is present in amounts of 15-900 g/m<2>, 20-800 g/m<2>, 25-850 g/m<2>, 30-800 g/m<2>, 35-800 g/m<2>, 40-750 g/m<2>, 45-700 g/m<2>, 50-650 g/m<2>, 55-600 g/m<2>, 60-550 g/m<2>, 60-500 g/m<2>, 55-450 g/m<2>, 60-400 g/m<2>, 65-350 g/m<2>, 70-300 g/m<2>, 75-250 g/m<2>, 80-300 g/m<2>, 85-150 g/m<2>, 90-200 g/m<2>, 95-150 g/m<2>, 100-190 g/m<2>, 110-180 g/m<2>, 110-170 g/m<2>, 130-160 g/m<2>, 140-150 g/m<2>, and about 145 g/m<2>. When measured in terms of thickness the coating material may be present as a film on the profile having a thickness of from about 0.5 mil to about 5 mil, preferably 1-4.5, 1.5-4, 2-3.5, 2.5-3, and about 2.75 mil.

Preferably the coating composition is a water based resin. In other cases the coating material may consists of a material in which each component undergoes polymerization or curing when exposed to pulsed UV light to form a continuous solid coating that is in direct and continuous contact with the surface of the profile after the UV curing step. In other embodiments of the invention the coating material includes one or more additives that do not directly undergo a chemical change during curing but are nonetheless present in the solid cured coating after exposure to pulsed UV light. Such additional components may include inert fillers and other additives and/or adjuvants that may provide stabilization against discoloration, improved heat resistance, scratch resistance, color in the cured coating such as hindered amine light stabilizers, pigments, dyes and fillers.

The profile, comprising a coating of uncured coating material is subsequently directed into a curing chamber and/or device. The curing chamber and/or device is separated from the coating chamber and/or device.

Preferably the delay between the exit of the profile from the vacuum coater to entry of the coated profile into the curing chamber is minimized. By minimizing transfer time between coating and curing there is less likelihood that undesirable oxidation, evaporation of the coating material, or aging of the uncured coating take place during the process of the invention.

Preferably the coated profile enters the curing device immediately after exiting the vacuum coater. Preferably the vacuum coater and curing devices are separated by a distance of no more than 2 meter, preferably no more than 0.5, 0.4, 0.2, 0.1, 0.05, 0.04, 0.03, 0.02, 0.01, 0.005, 0.002 meters.

In some embodiments of the invention the process is carried out continuously with a relaxing step. During relaxing the coated substrate is permitted to rest in ambient atmosphere. The resting is carried out such that the profile continues to move during the relaxing but the profile is not concurrently subjected to curing, coating or other steps which may affect the surface of the profile. Relaxing increases the ability of the coating to flatten before curing or permit additional cooling of the cured and/or uncured surface of the substrate. Relaxing may be carried for up to 30 seconds, preferably up to 25, 20, 15, 10, 9, 8, 7, 6, 5, 4, 3, 2, 1, 0.5 seconds.

In an especially preferred embodiment the relaxing is carried out by including a dry section in line with the coating and curing steps. For example, after coating the coated substrate may travel in ambient air for a distance of up to 10 meters before the substrate is subjected to any further processing steps such as curing, sanding, coating or alternatively may be stored at ambient temperature for sufficient time.

The coated substrate has a thin, even layer of coating material on these sides which are desired to be coated. The coated substrate is subjected to curing at a given temperature. Preferably during the curing the temperature of the substrate is raised by no more than 50° C. Some heating may occur for curing processes which are exothermic. In other embodiments of the invention the curing chamber and/or device is supplied with a cold inert gas supply to further lower the temperature within the curing device.

In a preferred embodiment of the invention the curing chamber or device is heated to a temperature that is 50° C. All ranges of any of the above stated and unstated temperature values are expressly included herein According to another embodiment of the present invention, the vacuum coaters may apply the same coating composition or different coating compositions (1K versus 2K; different additives, such as pigments). In a preferred embodiment the process is carried out with a device or apparatus that includes a first and a second vacuum coater.

For reasons of production continuity it is preferred to provide two or more (preferably four) vacuum coaters in the first coating station and two or more (preferably four) vacuum coaters in the second coating station. As such cleaning of and preparing a vacuum coater(s) for e.g. changing coating compositions or changing integrated mask configuration can be performed on one or more vacuum coater whilst at least one of the vacuum coaters in the coating station is applied for coating. In case the vacuum coaters require dummy profiles to be inserted during starting or stopping of the coater; it is preferred that the vacuum coaters are moved from an in-line to an off-line position with the dummy present therein for reducing the time needed to replace one vacuum coater with another one.

Process steps and devices that may be present before the vacuum coater and the curing chamber includes devices which include automated preparation steps of the profile such as applying a liquid or powder material by brush, fabric or other applicator. Typically the preparation includes several steps such as a 1) brushing operation followed by a de-dusting 2) potentially cleaning step with preferably a liquid to remove dust and degrease and activate the surface 3) potential further treatment of the surface such as flame treatment to increase surface tension of the surface.

According to yet another embodiment, the coating stations include a station whereby the coating is done by application of a foil with a coating or with an already pre-coated foil The foil itself can be preprinted.

Coating Composition

Coating composition to be used for the present invention include water based compositions one-component coating used in the present embodiment also include those having low VOC. The term "low VOC" refers to compositions that include volatile organic compounds at a concentration of less than 250 grams per liter and, in some embodiments, less than 100 grams per liter. The terms "volatile organic content" and "VOC" herein mean the volatility of the compound as measured by ASTM method D2369-90.

In accordance with the present invention, when a coating composition is used containing the low VOC resin other coating known to the art may be used. When a coating composition containing the low VOC resin is used with a low VOC, superior finish in an economically and ecologically acceptable way are obtained. Reducing the volatility of coalescents, solvents, plasticizers, etc. can adversely affect the balance of properties needed in a coating composition. Surprisingly within the process of the present invention, it has been found that the present process do not compromise on the desirable properties of the applied coating such as finish, color fastness/long term weathering performance: gloss and long term gloss retention performance; impact performance and UV aged impact performance and surface roughness; surface hardness/scratch resistance.

The coating according to the invention is preferably a water based resin, mainly composed of a liquid paint based on thermosetting resin, formed by cross linking of a polymer, in which hydroxyl and/or carboxyl groups are present with a hardener, and based on thermoplastic resin, which is dispersed in the paint. Preferred coating compositions of the present invention are one-component (1K) system. In the context of the present invention a one-component (1K) system is a thermosetting coating material in which the binder and cross linking agent are present alongside one another, i.e., in one component. Alternatively the coating can be a thermoplastic based resin, e.g. an acrylic based coating resing.

The amount of organic solvent may vary widely and thus may be tailored to the requirements of the case in hand. In view of the aqueous nature of the coating compositions of the present invention, however, efforts are made to minimize the amount therein of organic solvent. In this context it is a particular advantage that an organic solvent content of 0.1% to 15%, preferably 0.5% to 10%, and in particular 0.5% to 5% by weight in the coating material of the invention, based in each case on the coating material of the invention, is sufficient to achieve the advantageous technical effects of the present invention.

The coating compositions of the present invention term are compositions which contains at least one polymer in which hydroxyl and/or carboxyl groups are present. In addition, a product is present which ensures crosslinking of these polymers, For the polymer it is generally possible to use polyacrylates, epoxy resins, polyether, polyester, polyurethane, a caprolactam or a polyvinyl-based polymer.

The product which ensures crosslinking, also known as the hardener, is preferably composed of aromatic isocyanate. Alternatively, it may be aliphatic or cycloaliphatic, the use of the diisocyanates and triisocyanates being preferred. In this case, the linked polymer having a hydroxyl and/or carboxyl/isocyanate function is known as polyurethane.

Examples of coating compositions are polyurethane paint in which a thermoplastic resin in the form of a powder such as polyamide-11, is dispersed.

The term thermoplastic resins refers to the thermoplastic polymers having a softening point between 110 and 230° C. They are for example polyamides. They are products which are obtained by polycondensation of a diamine.

Further examples are the polyamide PA-6.6, the polyamide PA-6.10 and the polyamide PA-6.12. Mixtures are possible. Usually this involves PA-11, PA-12, PA-6/12 and/or PA-12.12, on their own or as mixtures, in short, preferably, polyamides having from 10 to 13 carbon atoms per carbon amide group.

The term "thermoplastic resins" also refers to polyether amides and polyether ester amides. The powders are obtained by grinding or direct polymerization to give the desired granulometric size. According to a preferred embodiment of the present invention, the coating application can be 1-component, 2-component or 3-component solvent based systems comprises a paint, a cross linker and a diluent.

Preferred coatings are water based coatings. In a preferred execution, the exterior side of the profile a 3 component coating is used whereas for the interior sides a 1-component coating is used.

Substrate

While any substrate material can be coated with the coating compositions according to the present invention, including such things as metal, glass, ceramics, paper, wood, and especially plastic material depending on the specific drying and/or curing requirements of the particular composition, the coating process and system of the present invention is particularly adapted for PVC substrates, and specifically as an window and/or door profile finish system. The substrate may also be bare substrate material or can be conventionally primed or covered with a foil.

The present application is particularly related to profile members used in the construction elements of windows, doors, gates or other constructional elements which are composed of a plurality of profile members, and more particular of profile members made of wood and/or plastic. The plastic used can be either a thermosetting plastic or a thermoplastic. The profile members are preferably substantially made of PVC. In accordance with another embodiment of the present invention, the construction element is composed of high grade, low grade PVC, industrial PVC and/or recycled PVC.

Coated Construction Elements

The vacuum coaters may apply the same coating composition or different coating compositions. In a preferred embodiment the process is carried out with a first and a second vacuum coater.

In accordance with a preferred embodiment, the present invention provides for a coated profile that match standard PVC profiles in terms of finish, color fastness/long term weathering performance; gloss and long term gloss retention performance; impact performance and UV aged impact performance and surface hardness/scratch resistance;

In accordance with the process of the present invention, a variety of aesthetic finishes, including a range of aesthetics, gloss finishes and textured and non plastic look finishes is provided.

In liquid paints this gloss reduction is usually achieved by the use of pigment and/or filler particles at high volume concentrations. However, this technique cannot be used as the sole route to gloss reduction in powder coatings as a high content of filler particles would lead to unacceptably too reduced a surface flow during curing.

Surprisingly within the process of the present invention, it has been found that the present process do not compromise on the gloss and long term gloss retention performance.

The features of this invention which are believed to be novel are set forth with particularity in the appended claims. The invention, together with its objects and the advantages thereof, may be best understood by reference to the following description taken in conjunction with the accompanying drawings.

FIG. 1 is a schematic view of a profile having 4 sides a) b) c) and d). FIG. 2A)B)C) is a schematic view of the present process having two coating stations whereby profiles having four sides passing through a first coating station to coat three sides and whereby the profiles are dried until these are transported into the curing station at temperature 20-50 C for 10 min. up to 150 min. Upon storage these profiles are passed onto a second coating station to coat the remaining side, said side being the transport side under the operation of the first station, and transported to a second curing station.

Figure 2C:
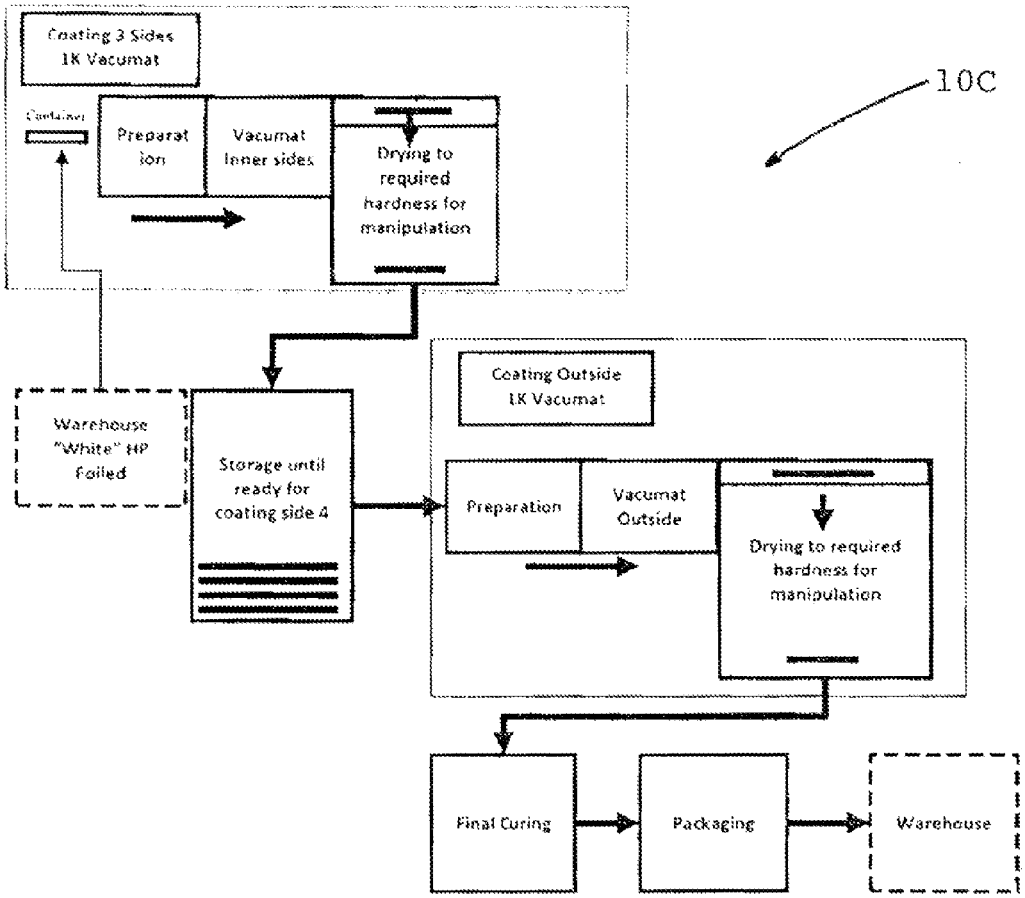

Detailed Description of the Preferred Embodiment FIG. 2C

As a construction element a PVC window profile is treated with the process 10 of the present invention. A water based resin is used as a coating composition with different pigments where bi-colored profiles are obtained thereof. Water based compositions one-component coating used in the present embodiment also include those having low VOC. Referring to the drawings in greater detail, and to FIG. 1, the invention is embodied in a process for coating continuously advancing the window profile which is advanced through a Vacumat® Profilecoat coating installation (commercialized by Schiele Maschienenbau GmbH) in the direction of arrow "A". The apparatus includes a housing, which defines a spray chamber (described hereinafter) having an inlet end and outlet end. The housing is substantially fabricated of stainless steel sheet metal material. The Vacumat Profilecoat preferably comprises internal masking for profile side portions not to be coated when advancing the profile through the Vacumat coating installation.

A conveying means in this case a conveyer belt, transports the profile through the spray chamber defined by housing from the inlet to the outlet ends and respectively. The conveying means is provided herein by an endless conveyor belt which, in essence, forms the bottom of the spray chamber. The conveyor can be run as fast as 30 m/min, with the system of the invention still being very effective.

Preferred spray guns are those which are capable of spraying up to a 100% solids curable coating composition. The characteristics of curable compositions are described above. The spray guns preferably are air spray guns which can be used with curable compositions, although air-assisted or airless spray guns may also be used.

It should be understood that the use of the terms curable composition herein and in the claims hereof are not intended to eliminate compositions that can be cured by electron beam curing processes. Specifically, a curing apparatus may incorporate a photo initiator, whereas an electron beam curing apparatus excites the coating without the initiator. Preferably, the system herein uses a "curable composition" which is a generic term herein and is meant to include compositions that can be cured either by heating, a UV curing apparatus, an electron beam curing apparatus, a laser beam curing apparatus or the like.

The fully colored profiles obtained demonstrate excellent finish, color fastness/long term weathering performance; gloss and long term gloss retention performance; impact performance and UV aged impact performance and surface hardness/scratch resistance and do not have a plastic look like appearance. In addition, whereby the inside surfaces which form depressed or recessed areas of the profile between the front and rear edges of the profile are uniformly coated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

EXAMPLES

Figure 1A:
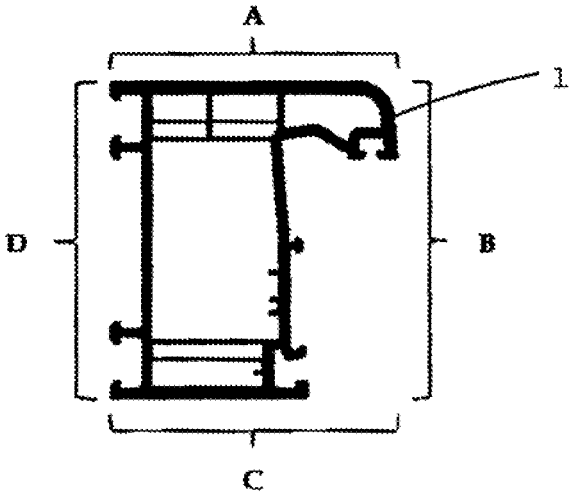
FIGS. 1A, B, and C is a plan view of three profiles each of which has four sides.

A first example concerns a window frame profile manufactured in a recycled PVC having four side portions a, b, c, d as represented in FIG. 1A, wherein side a represents the outdoor side of the frame in a mounted position.

This profile 1 is coated and is placed on a conveyer belt with its side portion facing down and is transported through the spray chamber of a Vacumat coater. The Vacumat is configured to mask both the transport side a and side portion d of the profile 1 during coating.

In the Vacumat coater a water-based 1K PUR coating, more precisely Zowo-plast® by Zobel®, is applied onto side portions b and c of the profile which are visible in a mounted position of the frame. After the coating step, the profile is transported into a curing station at a temperature of 50° C. for 15 minutes.

Subsequently, the profile is turned to rest on its side portion c, thereby exposing the side portion a, b and d.

Once turned the placed on a conveyer belt and advanced through a second coating station comprising a Vacumat coater with an internal mask preventing side portions b, c and d of the profile from being coated. The second Vacumat coater is provided with a water-based 1K-PUR coating (e.g. Rhenoplast KP1 plus commercialized by Rhenocoll) that is applied on side portion a of the profile. The colors of the coatings applied in both Vacumat coaters can be selected independently from one another.

Subsequently the profile is transported into the curing station at a temperature of 50° C. for 15 minutes and finally stored at ambient temperature for a period of 24 hours.

Figure 1B:
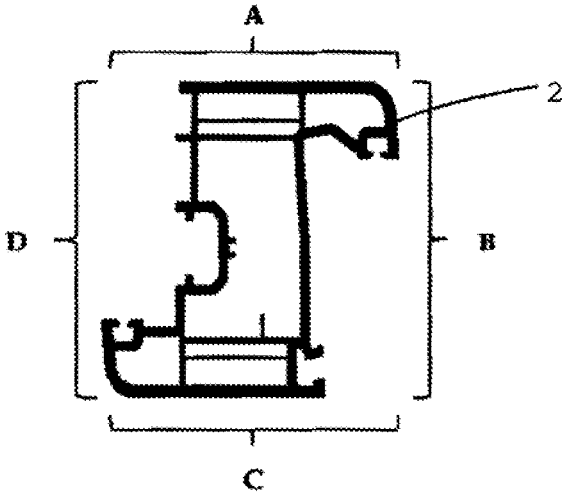
Figure 1C:
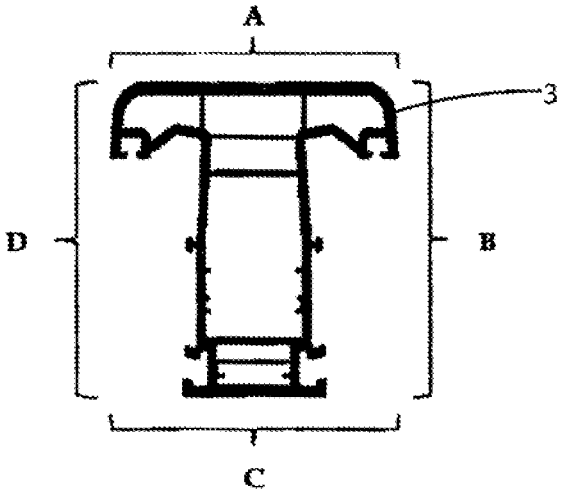

The second example concerns a window sash profile 2 manufactured in a low grade PVC having four side portions a, b, c and d as represented in FIG. 1B. Side a represents the side portion directed outwards in a mounted position of the sash.

In this example the coating installation comprises one coating station with two Vacumat coaters positioned in parallel. One in-line and one off-line.

The sash profile is provided on a conveyor belt and advanced past a first Vacumat coating station while positioned on its side a.

The first Vacumat coater is configured with an internal mask protecting the transport side a from being coated and is provided with a Rhenoplast KP 1 plus water-based 1K-PUR coating. As such a coating is applied on sides b, c and d in particular with a Rhenoplast KP 1 plus.

After leaving the first coating station, the profile 2 is transported into a curing station is at a temperature of 20° C. for 45 minutes and subsequently turned on its side portion c and placed on the conveyer belt.

Before feeding the profile to the coating station, the Vacumat coaters in the coating station are switched, thereby placing the first Vacumat coater off-line and positioning the second Vacumat-coater in-line, which second Vacumat coater is configured to mask profile side portions b, c and d and is provided with a water based 1K-PUR coating (e.g. Rhenoplast KP1 plus commercialized by Rhenocoll). As such only side portion a of the profile 2 is coated. Finally the profile 2 is transported into a curing station at 20° C. for 45 minutes and finally transported to a storage where it can cure at ambient temperature during 24 hours. The color of the coating applied in the first Vacumat coater differs from the color applied in the second Vacumat coater.

Example 3 concerns a transom profile 3 (FIG. 1C) manufactured in a high grade PVC. The coating installation applied comprises a first coating station comprising a Vacumat coater configured with an internal mask for side portion a of the profile; and a second coating station being a foil applicator. The profile 3 is first advanced through the Vacumat coater thereby applying a 1K water-based coating on side portions b, c and d thereof. The profile 3 is subsequently transported into a curing station for curing the applied coating at a temperature of 50° C. for 15 minutes, whereafter the profile 3 is turned to rest on its side c, and advanced through the second coating station wherein a foil coating is applied on the initial transport side a. Thereafter, the profile is stored for 24 hours.

Example 4 is a construction beam made of PVC with wood fibers dispersed therein. In a process according to the present invention, this beam can be coated on one or more of its side portions in a first coating station while resting on its transport side portion and subsequently coated on the transport side portion in a second coating station.

Example 5 concerns a construction profile advanced through a first coating station resting on its transport side a for coating side portions b, c and d. In the second coating station, the profile rests on its side c and a coating is applied on side portions a, b and d. As a result side portions b and d are coated twice, which can be advantageous in case one of the coatings is an essentially transparent protective coating.

The invention claimed is:

1. A multiple step coating process for coating a construction element having side portions, one of which is an unmasked transport side portion, and whereby at least three of the other side portions are coated, comprising:

(A) advancing the element past a vacuum coater first coating station on the unmasked transport side wherein a surface layer is applied onto one or more of the non transport sides of the element; and (B) subsequently advancing said coated element into further vacuum coater coating stations wherein a surface layer is applied to the unmasked transport side and/or one or more of the remaining sides of said element.

2. The coating process according to claim 1, wherein the construction element is a profile, said process comprising the steps of:

(A) advancing the profile past a vacuum coater first coating station wherein a surface layer is applied onto all of the non transport sides of the profile; and (B) advancing the profile into a second vacuum coater coating station wherein a surface layer is applied to the unmasked transport side of said profile.

3. The process according to claim 2, wherein the construction element is composed of PVC.

4. The process according to claim 3, wherein the construction element is composed of low grade PVC, industrial PVC and/or recycled PVC.

5. The process in accordance with claim 4, wherein one of the coating stations that apply the surface layers is a single vacuum coater.

6. The process according to claim 5, further comprising a preparation step wherein the side portions of the profile are prepared in a single preparation step.

7. The process according to claim 6, wherein the coating stations include a station wherein the coating is done by application of a foil with a coating.

8. The process according to claim 4, wherein the coating station comprises two or more vacuum coaters in parallel, at least one of which vacuum coaters is positioned in-line and at least one of which coaters is positioned off-line.

9. The process according to claim 8, wherein dummy profiles are inserted in said vacuum coaters at start-up and shut-down of the vacuum coaters and wherein said dummies are present in the vacuum coaters during switching that vacuum coaters from an in-line position to an off-line position or vice-versa.

10. The process according to claim 9, wherein the coating material is an aqueous coating composition in the process of claim 9 characterized in that said coating composition comprising less than 250 g/liter of volatile organic compounds.

11. The process according to claim 1, wherein the construction element is composed of PVC.

12. The process according to claim 1, wherein one of the coating stations that apply the surface layers is a single vacuum coater.

* * * * *